US005467631A

United States Patent [19]

Eberts et al.

[11] Patent Number: 5,467,631

[45] Date of Patent: Nov. 21, 1995

[54] METHOD FOR MANUFACTURING A PLUG-TYPE CHAMBER USED IN THE CASCADE DRAWING OF TUBES, AND DEVICE FOR IMPLEMENTING THE METHOD

[75] Inventors: Friedrich Eberts, Menden; Helmut Pohl, Eitorf, both of Germany

[73] Assignee: KM-Kabelmetal AG, Osnabruck, Germany

[21] Appl. No.: 203,146

[22] Filed: Feb. 28, 1994

[30] Foreign Application Priority Data

Feb. 27, 1993 [DE] Germany ..... 43 06 181.8

[51] Int. Cl.[6] ..... B21C 1/24

[52] U.S. Cl. ..... 72/283; 72/274

[58] Field of Search ..... 72/283, 282, 274, 72/278, 276

[56] References Cited

U.S. PATENT DOCUMENTS

| | | | |
|---|---|---|---|
| 307,993 | 11/1884 | Sharp | 72/282 |
| 2,535,339 | 12/1950 | Woeller | 72/283 |
| 3,820,230 | 6/1974 | Katunich | 72/283 |
| 4,534,199 | 8/1985 | Takaishi | 72/283 |
| 4,962,658 | 10/1990 | Komp | 72/283 |

FOREIGN PATENT DOCUMENTS

| | | | |
|---|---|---|---|
| 0353324 | 2/1990 | European Pat. Off. . | |
| 2623385 | 12/1977 | Germany | 72/283 |
| 2848805 | 5/1979 | Germany | 72/283 |

*Primary Examiner*—Daniel C. Crane
*Attorney, Agent, or Firm*—Kenyon & Kenyon

[57] ABSTRACT

A method and apparatus for manufacturing a plug-type chamber to accommodate at least two floating plugs for use in the cascade drawing of tubes is disclosed. A starting tube is first fixed in position by a clamping and denting device. A necking-down ring is subsequently moved with the help of a necking-down cylinder along a freely projecting end section of the starting tube. A punch is then pushed with the help of a cylinder into the end section of the tube. When the punch has reached its end position, the necking-down ring is pulled over the end section of the tube, and the outside diameter is reduced to its original size. The punch is subsequently removed, and two indentations are made on the periphery of the end section of the starting tube with the help of the clamping and denting device. Together with a drawing point produced through the reshaping of the unattached end of the starting tube, these indentations then form a plug-type chamber, in which several floating plugs are embedded, which interact with drawing dies during the cascade-drawing operation.

10 Claims, 6 Drawing Sheets

DR1

METHOD FOR MANUFACTURING A PLUG-TYPE CHAMBER USED IN THE CASCADE DRAWING OF TUBES, AND DEVICE FOR IMPLEMENTING THE METHOD

BACKGROUND OF THE INVENTION

The invention relates to a method for manufacturing a plug-type chamber, which accommodates at least two floating plugs and is delimited on one side by a drawing point and, on the other side, by an indentation applied to the outer surface of a starting tube. Such a method is useful in the cascade drawing of tubes made of non-ferrous metals or their alloys.

The invention further provides a device for implementing the method.

EPO 353 324 B1 discloses providing a plug-type chamber for floating plugs directly in the longitudinal section, behind a drawing point premolded on a starting tube. The plug-type chamber is delimited on its other side by an indentation, which is pressed in radially from the outside into the tubular material. As a result, the freely movable floating plugs are embedded in the plug-type chamber and are not lost. The starting tube can be an extruded tube, or rather a milled or a longitudinal-seam-welded tube.

To reduce the outside diameter and the wall thickness, the starting tube is moved in a plurality of drawing operations through drawing dies, which have progressively smaller opening cross-sections, the floating plugs having different diameters, each forming the corresponding thrust block.

In the disclosed case, in order to properly implement the cascade drawing operation, the wall thickness of the starting tube having a specific outside diameter must be dimensioned so as to enable the floating plug having the smallest diameter to move freely in the plug-type chamber until taking on the thrust-block function, even allowing for the manufacturing tolerances of the input stock, such as irregular outside diameter, uneven wall thickness and ovalness. If this dimensioning is not attended to, the floating plug can become jammed and cause the starting tube to be broken off. During every drawing operation, up until when the drawing die and the floating plug interact, a hollow drawing automatically takes place. During this hollow drawing operation, the inside diameter of the tubular section of the starting tube to be reduced in outside diameter is reduced in size in the area of the plug-type chamber. Therefore, the wall thickness is also slightly increased as a result of the compressing operation upon passing through the drawing die. For this reason, this technique forces one to reduce the wall thickness of the starting tube so as to guarantee the free mobility of the smallest floating plug. However, this results in less material being used and results in the less economical production of finished tubing.

There remains a need for improvements to this method, as well as for the associated structure necessary to practice such an improved method. Such an improved method should allow more material to be employed per starting tube and, accordingly, permit the production of more finished tubing without any loss of quality.

SUMMARY OF THE INVENTION

The method provides for the formation of a plug-type chamber having a wall thickness dimensioned to be less than the wall thickness of the remaining starting tube directly behind the drawing point. Thus, by this means, while taking into consideration the reductions in diameter during the drawing operation and the resultant decrease in wall-thickness, the inside diameter of the plug-type chamber is adjusted to a size that also guarantees the freedom of motion of the floating plug having the smallest diameter, up to the instant when this floating plug interacts with the drawing die assigned to it. Therefore, the special design of the plug-type chamber of the instant invention enables the use of a starting tube whose wall thickness is larger than that of the previously employed starting tube. Also, the unavoidable manufacturing tolerances no longer play a role in the outside diameter, in the wall thickness and in the ovalness, with respect to the freedom of motion of the floating plug having the smallest diameter. Moreover, associated with the necking- or drawing-down of the plug-type chamber is a lengthening by about 20% of the starting tube in the area of the plug-type chamber. By this means, the length of the tubular section required to produce the drawing point is reduced. Furthermore, the diameter of the drawing point is now retained at a smaller size. Consequently, the amount of waste material caused by the drawing point is advantageously reduced.

Practical tests have shown that the weight of materials employed in this process (including manufacturing losses) can be increased by about 25%. This is associated with a considerable increase in the output of finished tubing. For example, if an extruded tube having an outside diameter of 80 mm and a wall thickness of 5 mm is used at this point, then it can be reshaped in three drawing operations into a finished tube having an outside diameter of 46 mm and a wall thickness of 2.2 mm. Previously, this was attainable only with a starting tube having an outside diameter of 80 mm and a wall thickness of 4 mm.

According to one aspect of the invention, a clamping and denting device, as well as an expanding and necking-down device, are assigned to one another for optimal functioning. The clamping and denting device has radially movable fixing clamps and denting tools. With the help of the fixing clamps, a starting tube can be fixed locally in position, so that initially with the application of the punch forming the component of the expanding and necking-down device, a longitudinal section projecting in the feed direction of the starting tube over the clamping and denting device can be expanded so as to allow both the inside diameter as well as the outside diameter to be enlarged in this area. After the expanding operation, the outside diameter of the expanded longitudinal section (in which the punch remains in the starting tube) is necked down to the original outside diameter of the starting tube by a neck-down ring. If the necking-down ring and the punch are then removed from the starting tube, indentations can be produced on the starting tube with the help of the clamping and denting device and the denting tool assigned to this device, through which means a delimitation is formed for the later plug-type chamber. After the floating plugs have been introduced into the plug-type chamber, the drawing points are finally premolded on the free end of the starting tube.

In order to displace the punch and the necking-down ring in the longitudinal direction of the starting tube, one embodiment provides for two hydraulically actuated cylinders, which are mechanically coupled to one another and have piston rods that can be driven out in opposite directions. The cylinder housings are locally fixed. The piston rod of the expanding cylinder, which is capable of being driven out in the direction of the starting tube, is connected to the punch.

The punch is used to widen the end section of the starting tube, and when this end section is necked down, it is used as a thrust block for the necking-down ring. The piston rod of the necking-down cylinder that can be driven out in the other direction is joined via a rod assembly to the necking-down ring, which runs parallel to the longitudinal axes of the cylinders. The necking-down ring is arranged at the unattached end of the rod assembly.

To manufacture the plug-type chamber at the front, feed-end of the starting tube, the starting tube is initially moved past the clamping and denting device a length dependent on the axial extension length of the plug-type chamber and the length of the drawing point. The fixing clamps are subsequently applied to the starting tube in order to fix the starting tube locally in position.

The starting position of the expanding and necking-down device is such that the expanding cylinder is retracted and the necking-down cylinder is extended. After the starting tube is fixed in position, the necking-down cylinder is then actuated in the retraction-stroke sense, so that the necking-down ring slides along the end section of the starting tube projecting over the clamping and denting device. After the end position is reached, the expanding cylinder is actuated in the extension-stroke sense, and the punch is thrust into the starting tube while the inside and outside diameter are expanded. If the punch has reached its end position, the necking-down cylinder is actuated in the extension-stroke sense, and the outside diameter of the expanded longitudinal section is necked down to the original dimensions. In this case, the punch remains in the starting tube. After the necking-down operation, the expanding cylinder is also actuated in the retraction-stroke sense, and the punch is drawn out of the starting tube. The denting tools are subsequently moved radially inward, and two indentations are produced that are offset by 180°. By the completion of this step, the floating plugs can be introduced into the plug-type chamber. Finally, the drawing point is premolded at the free end of the longitudinal section provided with a reduced wall thickness.

BRIEF DESCRIPTION OF THE DRAWINGS

The invention shall be clarified in greater detail by reference to discussion of the exemplary embodiment depicted in the drawings.

DETAILED DESCRIPTION

Figure 1:
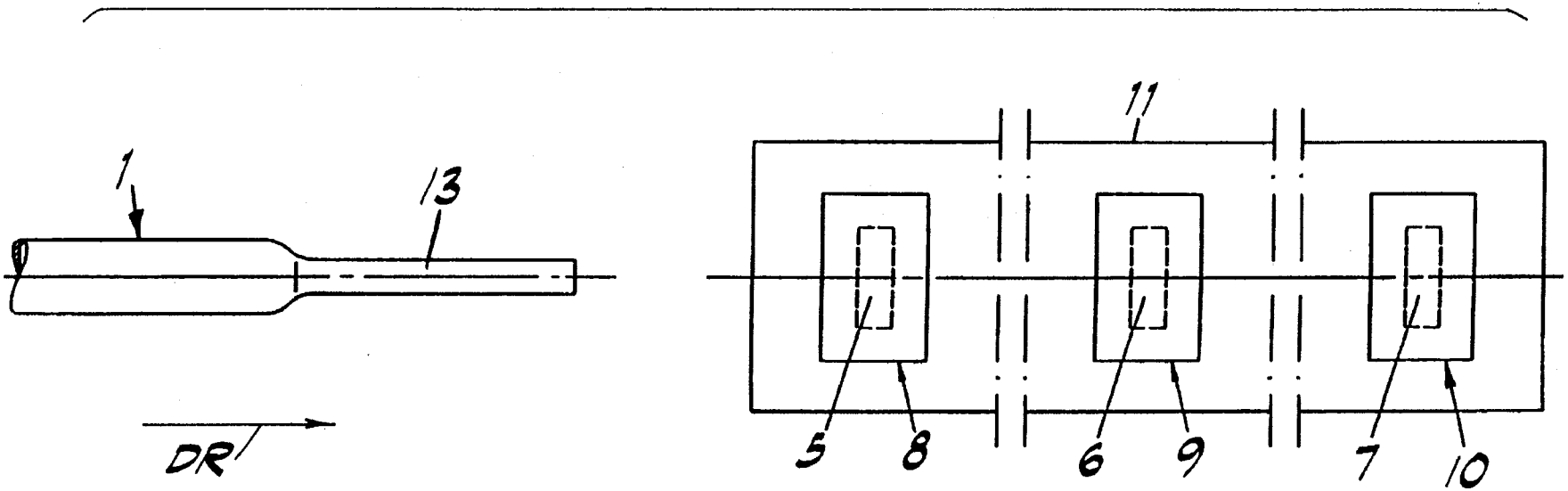
FIG. 1 shows in a schematic side view, a drawing cascade arrangement for reducing the diameter of a copper starting tube.

The method can be considered with regard to the cascade drawing of seamless tubes of non-ferrous metals (e.g., copper or its alloys). Such tubes may be extruded, milled, or longitudinally-seam welded. The method of the invention provides for floating plugs 2, 3 and 4 that have been introduced into a starting tube 1 to interact with drawing dies 5, 6 and 7 (FIGS. 1 and 9), each of which in turn can be viewed as a component of a drawing machine 8, 9 and 10 of a drawing-cascade arrangement 11. In the case of the exemplified embodiment of FIG. 1, three drawing machines 8, 9 and 10 are provided with three drawing dies 5, 6 and 7. The cross-section of the starting tube 1 is reduced in these drawing dies 5, 6 and 7 in accordance with the diameters of the feed openings of the drawing dies 5, 6 and 7, and the diameters of the floating plugs 2, 3 and 4 are progressively smaller as well (see FIG. 9).

The floating plugs 2, 3 and 4 required to implement the method (FIG. 9), are introduced loosely, i.e., freely moveable into a plug-type chamber 12 within the tube. This plug-type chamber 12 is situated at the front or feed-directional end DR of the starting tube 1, between a drawing point 13 and two indentations 14 that reduce the cross-section of the starting tube 1.

To manufacture this plug-type chamber 12, a device 15 is used, which is illustrated in greater detail in FIGS. 2 through 6.

This device 15 (FIG. 2) comprises a clamping and denting device 16 for working on starting tube 1, as well as an expanding and necking-down unit 17 that is arranged coaxially to and is able to be displaced relatively to the clamping and denting device 16.

The clamping and denting device 16 is provided with radially movable fixing clamps 18, which serve to fix the starting tube 1 locally in position. Joined to the fixing clamps 18 are mounting supports 19, which support the denting tools 20, so that the denting tools 20 are diametrically offset from one another and can be displaced radially in the direction of the starting tube 1.

The expanding and necking-down device 17 comprises two hydraulically actuated cylinders 21 and 22, whose housings 23 and 24 are locally fixed and are coupled to one another on the front side. The expanding cylinder 21 closest to the clamping and denting device 16 has a piston rod 25 that is capable of being driven out in the direction of the clamping and denting device 16 and which bears a punch 26. The other necking-down cylinder 22 has a piston rod 27 that is capable of being driven out in the feed direction DR of the starting tube 1. A cross arm 28 is secured to the free end of the piston rod 27. Via a rod assembly 29 running parallel to the cylinders 21, 22, the cross arm 28 is operatively connected to a necking-down ring 30, which is situated in the starting position of the device 15 in FIG. 2, more or less at the free end of the punch 26.

Figure 9:
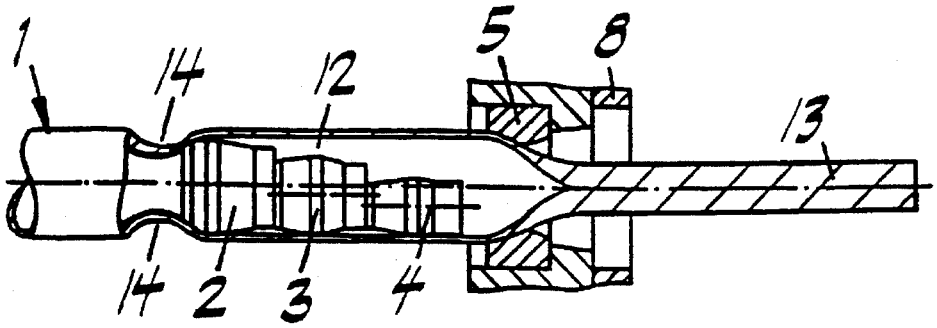
FIGS. 9–14 illustrate in vertical, longitudinal sections, various reshaping situations during the cascade-drawing of the starting tube.

To manufacture the plug-type chamber 12 in accordance with FIG. 9, the starting tube 1, which in one exemplary embodiment has an outside diameter AD of 80 mm and a wall thickness D of 5 mm, is initially moved through the clamping and denting device 16 to an extent that allows a longitudinal section 31 to jut out over the clamping and denting device 16. This protruding section is necessary for the manufacture of the plug-type chamber 12, and the drawing point 13. Once this position is reached, the starting tube 1 is locally fixed in position with the aid of the fixing clamps 18.

Figure 3:
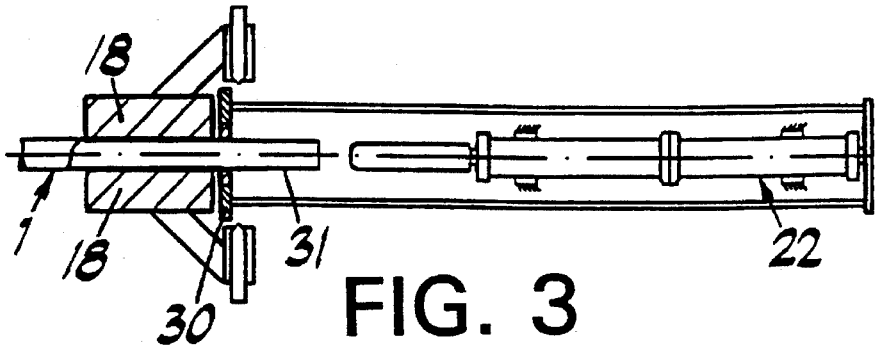

The necking-down cylinder 22 is now actuated in the retraction-stroke sense, in accordance with FIG. 3, in which piston rod 27 retracts into cylinder 22. This movement simultaneously causes the necking-down ring 30 to slide along the outer surface of the end section 31 of the starting tube 1 that is to be reshaped, moving to the position shown in FIG. 3 on the front side of the fixing clamps 18.

Figure 4:
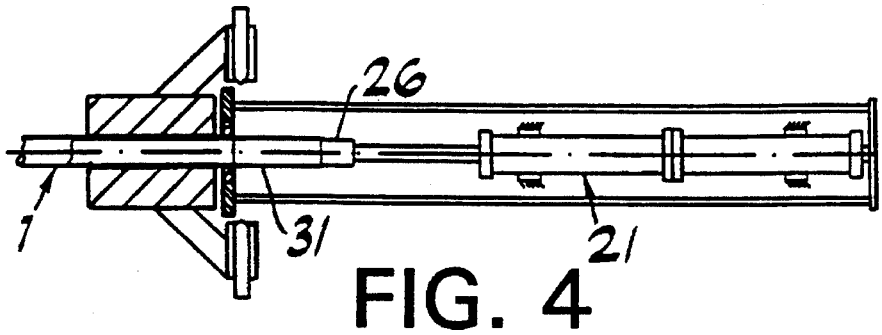
Figure 7:
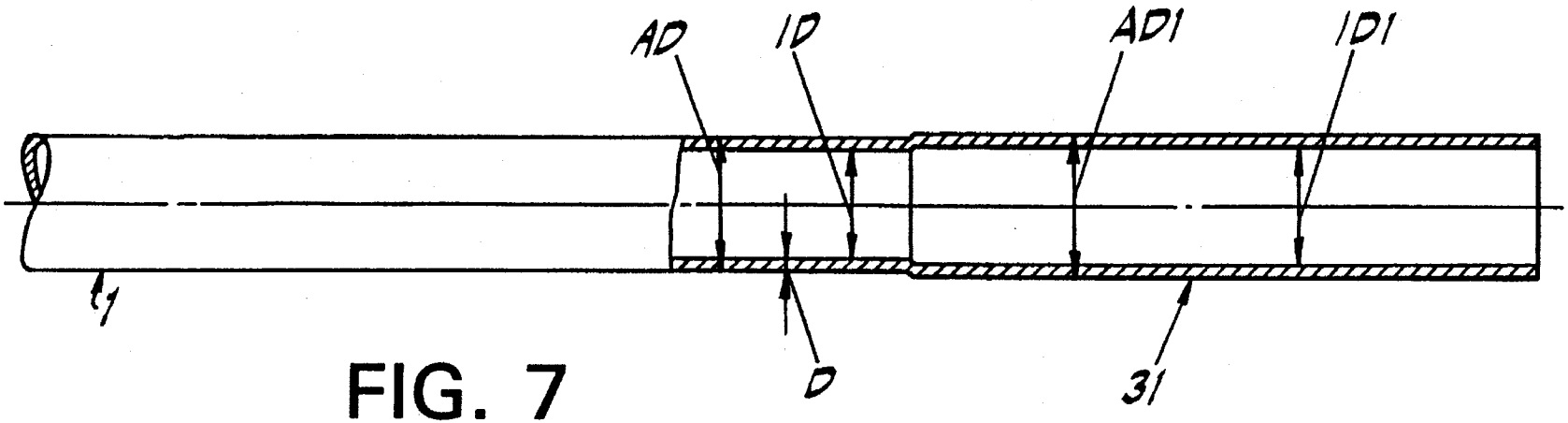
FIG. 7 is a partially vertical longitudinal sectional view of the end section of the starting tube after the expanding operation.

In accordance with FIG. 4, the expanding cylinder 21 is subsequently actuated in the extension-stroke sense to the left, so that the punch 26 penetrates into the end section 31 (which is approximately 365 mm long) as shown in FIG. 7. Both the inside diameter ID of 70 mm, as well as the outside diameter AD of 80 mm of the starting tube 1, are enlarged to the inside diameter ID1 of 72 mm and to the outside diameter AD1 of 82 mm.

Figure 5:
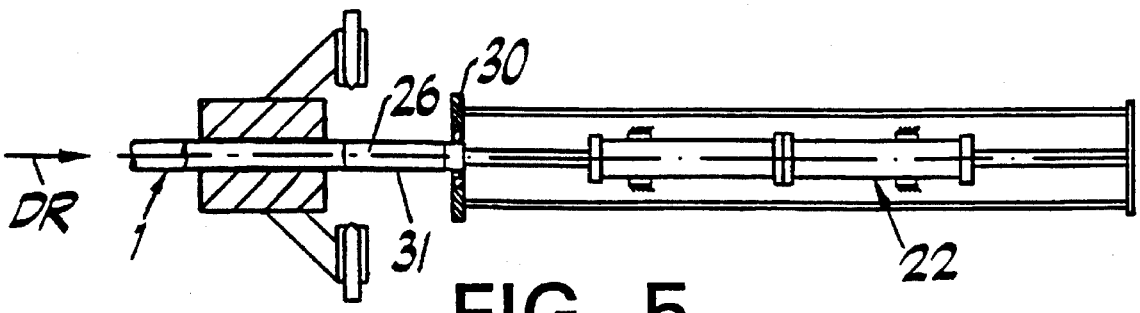
Figure 8:
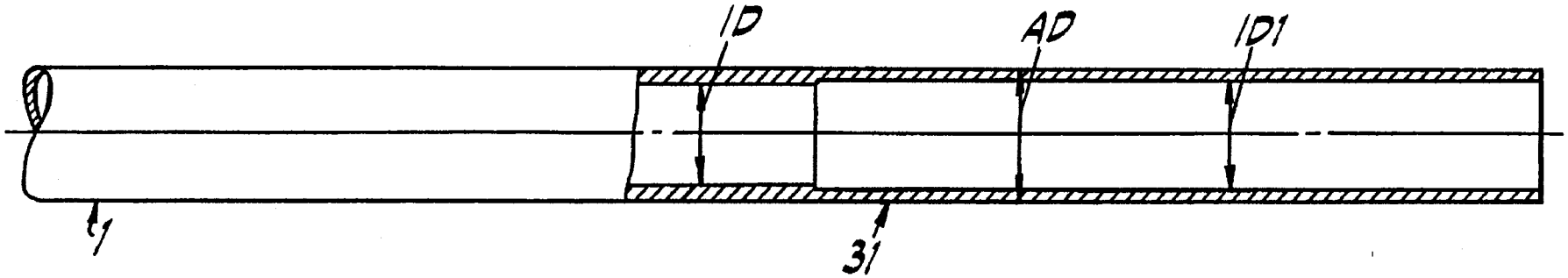
FIG. 8 further illustrates the tube depicted in FIG. 7 after the necking-down operation on the peripheral side.

Next, the necking-down ring 30 is moved, in accordance with FIG. 5, in the feed direction DR of the starting tube 1 through the actuation of the necking-down cylinder 22 in the extension-stroke sense. The movement of the necking-down ring 30 serves to return the outside diameter of the tube to its original outside diameter AD of 80 mm along the punch 26 remaining in the end section 31 as a thrust block (see FIG. 8). However, the inside diameter ID1 that has been widened to 72 mm does not contract to its original diameter. Furthermore, due to the necking-down process, the end section 31 is lengthened from the starting length of about 365 mm to about 450 mm. To recapitulate, the inner diameter of the tube is increased, the outer diameter is now unchanged, the tube is lengthened, and the tube wall thickness reduced along this section.

Figure 2:
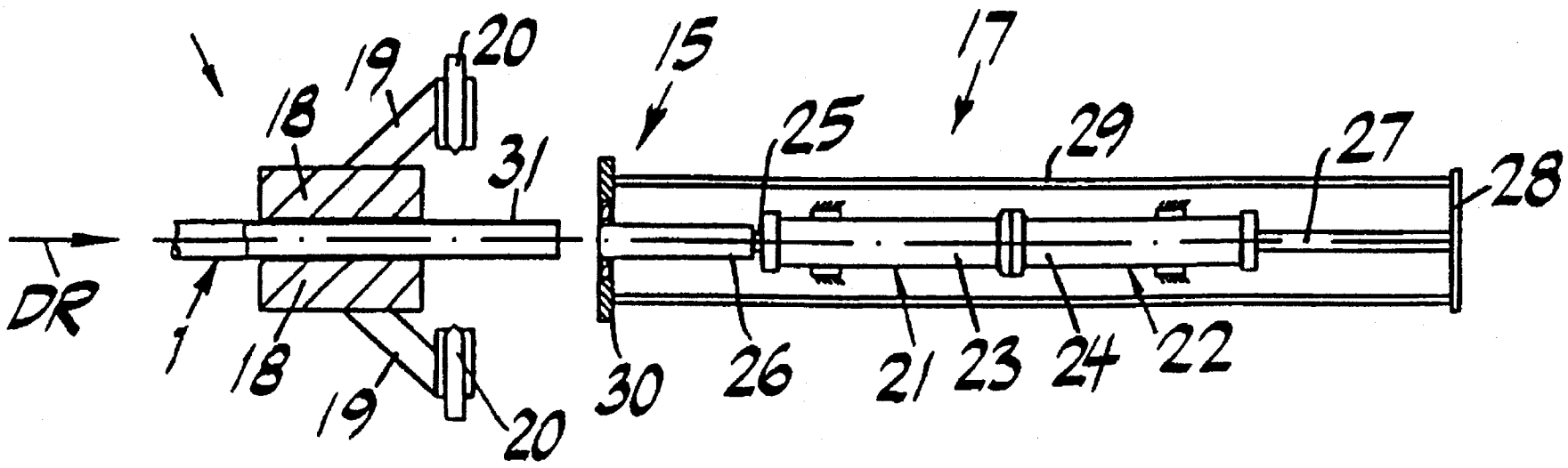
FIGS. 2–6 provide schematic, vertical longitudinally sectional views of five different working positions of a clamping and denting device, as well as an expanding and necking-down device assigned to the clamping and denting device.
Figure 6:
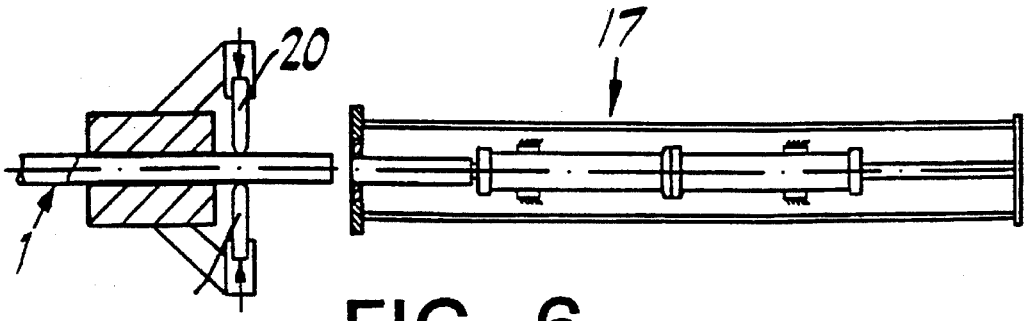

The expanding and necking-down device 17 is now situated again, in accordance with FIG. 6, in the starting position in accordance with the representation of FIG. 2. This now makes it possible for two diametrically opposed indentations 14 (FIG. 9) to be produced on the outer surface of the starting tube 1 by moving the denting tools 20 radially inward in accordance with FIG. 6. The inner cross-section of the starting tube 1 is also hereby reduced, so that one of the delimitations of the plug-type chamber 12 is formed in this manner.

At this point, the floating plugs 2, 3, 4 are introduced into the plug-type chamber 2, and the drawing point 13 is subsequently formed or premolded (typically this is done by a hammering machine). The starting tube 1 is thus prepared for a triple drawing operation through the drawing cascade arrangement 11.

The drawing operation proceeds generally as follows:

If the starting tube 1 is moved in the feed direction DR, in accordance with FIG. 9, with the drawing point 13, then the drawing punches 3 and 4 travel unhindered through the drawing die 5, while the starting tube 1 is, in fact, reduced in its outside and inside diameter—although not in its wall thickness in a so-called hollow drawing operation. This continues until the plug 2 is retained by the indentations 14.

The plugs themselves have a forward shaping part, which defines the inside diameter of the tube, and a conical part, which widens to a larger diameter and which retains the floating plug in the drawing die 5.

Figure 10:
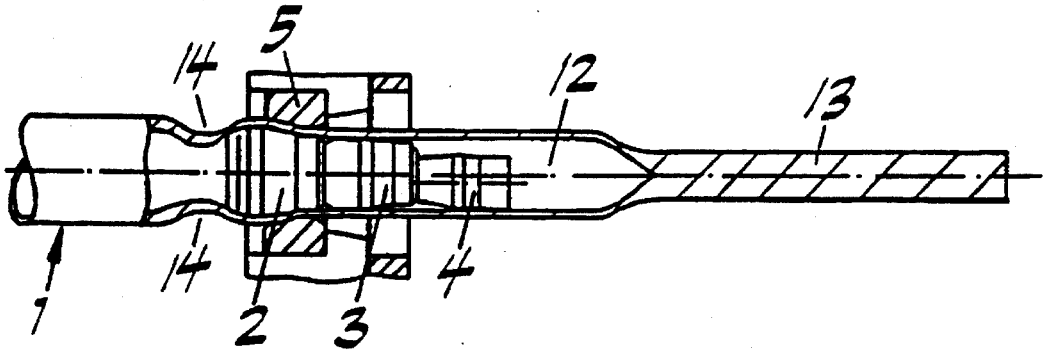
Figure 11:
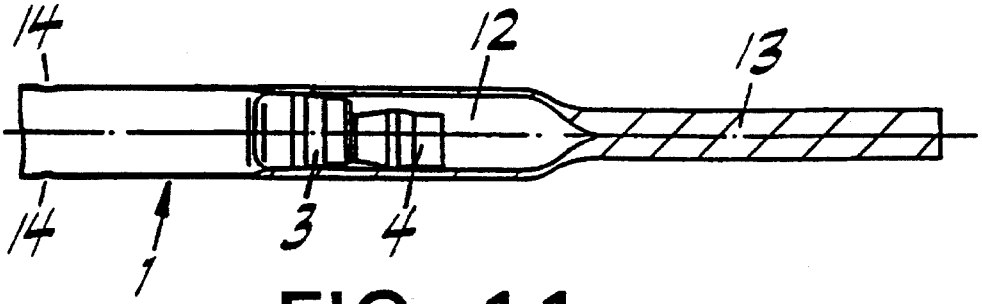

Once the floating plug 2 is at the area of the drawing die 5, and the indentations 14 are initially engaged, the floating plug 2 is drawn into the drawing die 5 up to the drawing position (FIG. 10). Beginning at this point, the wall thickness of the starting tube 1 is also reduced as the die, plug, and drawn tube are in cooperative engagement with each other. This situation is illustrated in FIG. 11. It can be seen in this case that the floating plugs 3 and 4 are still situated in that area of the plug-type chamber 12, whose wall thickness has not yet been reduced. However, the area of the starting tube 1 having a diminished wall thickness begins directly behind the floating plug 3. As the tube is drawn past the interface between the floating plug 2 and die 5, the rear conical part of the plug 2 causes the initial set of indentations to widen, so that the plug can be moved through the tube to the opposite end, from which it can fall out. The next plug/die pair are brought into play. In this case then, two additional indentations 14 are also applied at a distance from the floating plug 3, in order to delimit the displacement of the floating plug 3 in the plug-type chamber 12 during the subsequent drawing operation.

Figure 12:
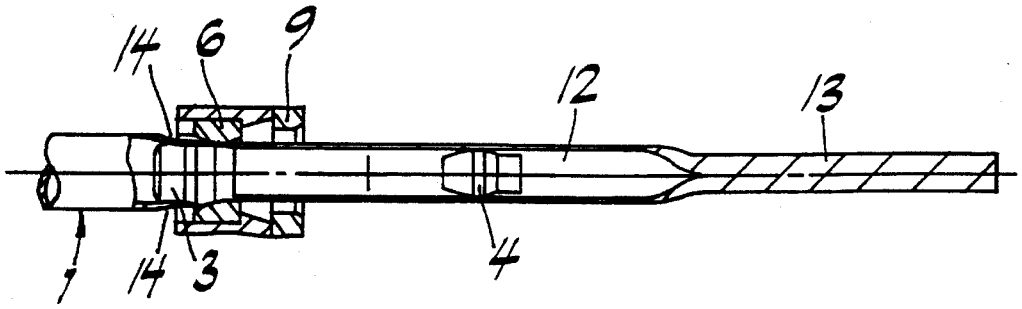

The previous steps are then repeated. The outside diameter of the starting tube 1 is reduced in size once more at the next drawing die 6 (FIG. 12), directly behind the drawing point 13, so that the drawing plug 3 is retained at this drawing die 6. In this case, a hollow drawing operation also takes place, which corresponds to the distance of the indentations 14 from the floating plug 3. If the floating plug 3 in accordance with FIG. 12 reaches the drawing position at the drawing die 6, a further reduction in the wall thickness of the starting tube 1 is undertaken here.

Figure 13:
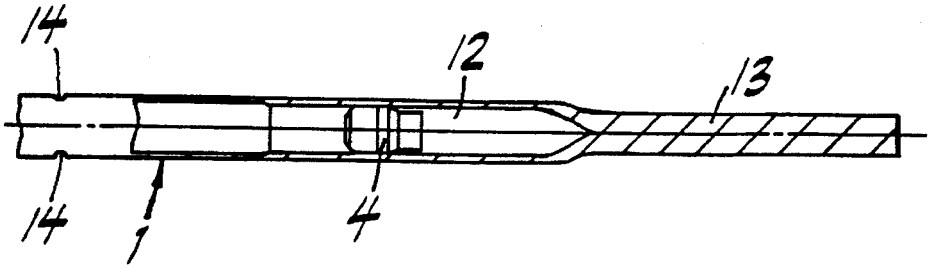
Figure 14:
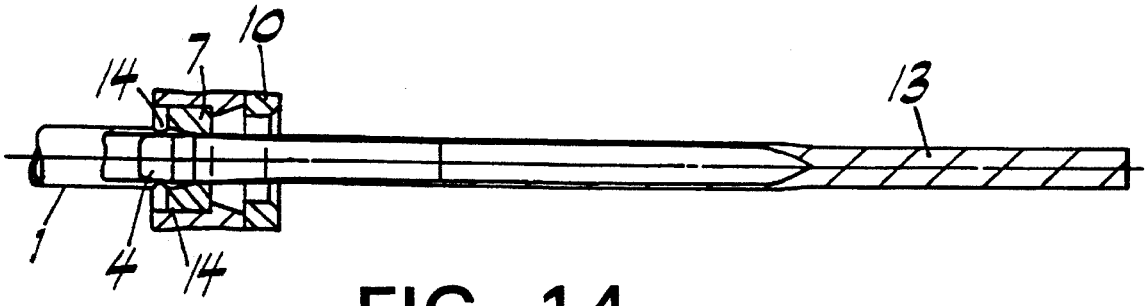

Finally, to continue the cascade drawing operation, additional indentations 14 are produced in accordance with FIG. 13 at a distance from the smallest floating plug 4, these indentations 14 then assuring in the area of the drawing die 7, in accordance with FIG. 14, that the floating plug 4 interacts with the drawing die 7 to reduce the wall thickness to the final dimensions.

This invention can be practiced with fewer (e.g., 2) floating plugs or with additional floating plugs.

What is claimed is:

1. A method for manufacturing a plug-type chamber to accommodate at least two floating plugs for use in the cascade drawing of tubes made of non-ferrous metal alloys, comprising the steps of:

expanding the inner diameter, and the outer diameter of the tube at a front, feed directional end of the tube;

reducing the outer diameter of the tube until it reaches its original diameter along at least a portion of the section of tube whose outside diameter has been expanded in the previous step whilst the tube is lengthened;

forming an indentation in the tube upstream from the front of the tube;

inserting floating plugs into the tube section; and forming a drawing point onto the free end of the tube.

2. A device for manufacturing a plug-type chamber to accommodate at least two floating plugs for use in the cascade drawing of tubes made of non-ferrous metal alloys, comprising:

a clamping device disposable about a length of tube, said clamping device having radially movable fixing clamps for selectively fixing the clamping device to the tube, said clamping device further having attached thereto a denting tool for creating an indentation on the tube;

a tool for expanding both the inner diameter and the outer diameter of a section of tube, said tool comprising a punch that is displaceable along the longitudinal axis of the tube towards the free end of the tube; and a necking down tool comprising a ring that is coaxial with the front of the tube and which is configured to be axially displaced along the axis of the tube so that it can be brought forward to the general position of the clamping device, wherein the punch serves to expand the inner diameter and the outer diameter of the tube, and the necking down tool serves to then reduce the outer diameter of the tube.

3. The device according to claim 2, further comprising two hydraulically actuated cylinders that are coupled to one another along the longitudinal axis of the starting tube that have piston rods that are able to be driven out from the cylinders in opposite directions, one piston rod having a punch attached thereto and capable of being driven out in the direction of the clamping and denting device, and the other piston rod being joined to the necking-down ring via a rod assembly situated parallel to the cylinders.

4. A method for manufacturing a plug-type chamber at the free end of a tube to accommodate at least two floating plugs for use in the cascade drawing of tubes made of metal alloys, comprising the steps of:

expanding the inner diameter and the outer diameter of the tube at a portion of its free end;

reducing the outer diameter of the tube along a portion of this section whilst not reducing the inner diameter of this section of the tube, thereby lengthening the tube and forming an expanded chamber within the tube;

producing an indentation in the tube upstream from the front of the tube, thereby further delimiting the chamber from the remainder of the tube;

inserting floating plugs into the chamber; and forming a drawing point onto the free end of the tube.

5. A method for manufacturing a plug-type chamber as in claim 4, in which a piston is used to drive a punch into the tube so as to expand the inner diameter of the tube.

6. A method for manufacturing a plug-type chamber as in claim 4, in which the reduction of the outer diameter of the tube is accomplished by drawing a ring over that section of the tube.

7. A method for manufacturing a plug-type chamber as in claim 4, in which the indentation serves to prevent the plug to which it is adjacent from accidentally falling out of one end of the tube.

8. A device for manufacturing a plug-type chamber to accommodate at least two floating plugs for use in the cascade drawing of tubes made of non-ferrous metal alloys, comprising:

a clamping device disposable about a length of tube, said clamping device having radially movable fixing clamps for selectively fixing the clamping device to the tube, said clamping device further having attached thereto a denting tool for creating an indentation on the tube;

means for expanding both the inner diameter and the outer diameter of a section of tube; and means for reducing the outer diameter of the tube.

9. The device according to claim 8, further comprising two hydraulically actuated cylinders that are coupled to one another along the longitudinal axis of the starting tube that have piston rods that are able to be driven out from the cylinders in opposite directions, one piston rod having a punch attached thereto and capable of being driven out in the direction of the clamping and denting device, and the other piston rod being joined to a necking-down ring via a rod assembly situated parallel to the cylinders.

10. A device for manufacturing a plug-type chamber to accommodate at least two floating plugs for use in the cascade drawing of tubes made of metal, comprising:

a clamping device disposable about a length of tube, said clamping device having radially movable fixing clamps for selectively fixing the clamping device to the tube, said clamping device further having attached thereto a denting tool for creating an indentation on the tube;

a piston-driven tool for expanding both the inner diameter and the outer diameter of a section of tube, said tool comprising a punch that is displaceable by the piston along the longitudinal axis of the tube towards the free end of the tube; and a necking down tool comprising a ring that is coaxial with the front of the tube and which is configured to be axially displaced by a second piston along the axis of the tube so that it can be brought forward to the general position of the clamping device, wherein the punch serves to expand the inner diameter and the outer diameter of the tube, and the necking down tool serves to then reduce the outer diameter of the tube so as to create an expanded chamber within the tube, which is further delimited by the indentations made by the denting tool.

* * * * *